United States Patent [19]

Hay

[11] 3,949,812

[45] Apr. 13, 1976

[54] FIRE EXTINGUISHING SYSTEM

[76] Inventor: George P. Hay, P.O. Box 587, Springfield, Mo. 65801

[22] Filed: Nov. 12, 1974

[21] Appl. No.: 523,124

[52] U.S. Cl. ..... 169/61; 169/9; 160/20

[51] Int. Cl.[2] ..... A62C 37/06

[58] Field of Search ..... 169/43, 46, 54, 5, 9, 56, 169/60, 61, 19, 20

[56] References Cited

UNITED STATES PATENTS

| | | | |
|---|---|---|---|
| 1,958,893 | 5/1934 | Kintner et al. | 169/54 X |
| 2,933,139 | 4/1960 | O'Rear | 169/9 |
| 3,507,333 | 4/1970 | Quant et al. | 160/54 X |
| 3,602,313 | 8/1971 | Achs | 169/54 X |
| 3,865,192 | 2/1975 | Dunphy | 169/9 X |

*Primary Examiner*—John J. Love
*Assistant Examiner*—Michael Mar
*Attorney, Agent, or Firm*—Fleit & Jacobson

[57] ABSTRACT

A fire extinguishing system includes a container of extinguishing agent and a valve for controlling the discharge of the extinguishing agent. The discharge control valve is opened and closed by a pneumatic cylinder operated by pressurized gas through a solenoid-actuated directional control valve. The solenoid of the directional control valve is coupled with a pneumatic timing relay actuated by a temperature sensor. With this arrangement, a pre-determined amount of extinghishing agent is discharged from the container and delivered to the hazard area and then the discharge shut-off. The discharge cycle is repeated, if necessary, until the fire is extinguished. The system is then automatically reset and ready to deliver further extinguishing agent on demand. The system also includes manual or automatic means for purging the delivery line downstream of the discharge control valve.

14 Claims, 3 Drawing Figures

FIRE EXTINGUISHING SYSTEM

BACKGROUND OF THE INVENTION

The present invention relates to a fire extinguishing system for automatically discharging a predetermined amount of extinguishing agent and then, if necessary, repeating the discharge cycle until the fire is extinguished. The system is then reset and available for automatically extinguishing further fires.

A fire may be extinguished by various well known methods including cooling the burning materials, blanketing the fire with inert gas, inhibiting the combustion process with appropriate chemicals and using solid particles or the like to prevent access of air. Fire extinguishing system use one or more of these methods with the exact method employed depending upon the nature of the fire. Water is one of the most effective cooling agents used in fire extinguishing systems and may include wetting agents for added penetration and forming agents for exclusion of air and to help cool the burning materials. However, there are many fires on which water should not be used and on which dry extinguishers and the like are preferred. The typical dry extinguisher comprises a dry powder consisting principally of sodium bicarbonate which generates carbon dioxide, cools the burning materials, and prevents access of air.

Fire extinguishing systems employing water, dry chemicals and the like as extinguishing agents normally require a propellant for delivering the extinguishing agent to the hazard area. The propellant may be generated when needed or stored in a separate container. Also, the extinguishing agent may be pre-pressurized by storing the propellant with the extinguishing agent in the same vessel. Fire extinguishing systems have been developed using this pre-pressurized or stored pressure concept in which mechanical or electrical means, activated by a rise in temperature, have been used to rupture or mechanically open the valve of the stored pressure container thereby delivering the extinguishing agent to the hazard area. However, these systems have no means for automatically discharging only a predetermined amount of extinguishing agent and then, only if nencessary, repeating the discharge cycle until the fire is extinguished. Accordingly, these systems have many disadvantages including the delivery of excess extinguishing agent to the hazard area which wastes valuable chemicals and may result in unnecessary damage to materials stored in the hazard area by the excess extinguishing agent.

Fire extinguishing systems typically employ a delivery hose connected directly to the extinguishing agent vessel and a manaully operated discharge valve at the end of the delivery hose. This arrangement requires the operator to use both hands to hold the delivery hose and to operate the discharge valve. Also, systems of this type do not provide for automatic purging of the delivery hose and accordingly the delivery hose must be manually purged or otherwise the delivery hose may become stopped up and the system rendered inoperative.

In view of the foregoing, an object of the present invention is to provide an improved film extinguishing system.

A further object of the present invention is to provide a fire extinguishing system which automatically delivers a predetermined amount of extinguishing agent to the hazard area.

A still further object of the present invention is to provide a fire extinguishing system which automatically discharges a pre-determined amount of extinguishing agent and then, if necessary, repeats the discharge cycle until the fire has been extinguished.

A yet further object of the present invention is to provide a fire extinguishing system which automatically delivers a predetermined amount of extinguishing agent or demand and then resets so that it is available for automatically extinguishing further fires.

Yet another object of the present invention is to provide a fire extinguishing system in which the delivery hose is easily purged, either manually or automatically.

Still another object of the present invention is to provide a fire extinguishing system which is simple in construction, easy to manufacture and reliable in operation.

Still further objects of the present invention will become apparent upon reading the following description taken in conjunction with the appended claims.

SUMMARY OF THE INVENTION

The present invention is broadly directed to a fire extinguishing system which delivers a pre-determined amount of extinguishing agent to the hazard area, shuts itself off and then, if necessary, repeats this cycle until the fire is extinguished. This cycle can be repeated in the event of further fires since the system automatically resets itself for further discharge of extinguishing agent. The fire extinguishing system includes a container of extinguishing agent and a valve for controlling the discharge of the extinguishing agent from the container which is preferably pre-pressurized with propellant gas. The discharge control valve, typically a one quarter-turn ball valve mounted on the extinguishing agent container, is opened and closed by means of a pneumatic cylinder and appropriate mechanical linkage connecting the piston rod of the pneumatic cylinder to the discharge control valve. The pneumatic cylinder is operated by pressurized gas, preferably from the pre-pressurized extinguishing agent container, through a solenoid-actuated directional control valve. The solenoid of the directional control valve is coupled with a pneumatic timing relay actuated by a temperature sensor.

When a hazard is sensed, the pneumatic timing relay energizes the solenoid of the directional control valve. This causes the pneumatic cylinder to open the discharge control valve for a pre-determined period of time controlled by the relay. After the pre-determined period of time has elapsed, the relay de-energizes the solenoid of the directional control valve. This causes the pneumatic cylinder to close the discharge control valve. The solenoid is re-energized by the relay and the discharge control valve reopened if the fire has not been extinguished. This cycle is automatically repeated until the fire is extinguished. If a further hazard is sensed after the first fire is extinguished, the pneumatic timing relay will again energize the solenoid of the directional control valve and extinguishing agent will be discharged as described above until the fire is extinguished. Accordingly, the system is always available for automatically discharging extinguishing agent in the event a hazard is detected so long as the system is kept supplied with extinguishing agent and propellant.

In accordance with another aspect of the invention, the discharge control valve is mounted at the inlet of the delivery line and the delivery line is manually or automatically purged downstream of the discharge control valve. In both the manual and automatic systems, pressurized gas, preferably from the pre-pressurized extinguishing agent container, is used to purge the delivery line. In the automatic system, the flow of pressurized gas into the delivery line is controlled by a purge control valve which is pilot operated to open each time the discharge control valve is closed. This is accomplished by means of the directional control valve, a pulse valve and a pilot actuator for the purge control valve.

In accordance with the present fire extinguishing system, an extinguishing agent container of any predetermined size can be employed and the extinguishing agent can be delivered to as many hazard areas as are necessary by using a plurality of discharge control valves and associated actuating systems. Furthermore, it is possible with the fire extinguishing system of the present invention to first apply dry chemical and then, after the dry chemical container is exhausted, have another container sitting beside it that is filled with "lite" water or some other extinguishing agent discharge its contents through the same cycle that the first container has gone through. This allows the flames to be extinguished with dry chemical followed by "lite" water or foam or some other extinguishing agent.

It is possible in accordance with the fire extinguishing system of the present invention to use the existing head pressure of propellant gas in the extinguishing agent container to open and close the discharge and purge control valves and/or to use pressurized gas from a separate container. The pressurized gas container can be attached to the system for backup pressure of can be provided for the sole purpose of opening the discharge and purge control valves to allow the extinguishing agent to be expelled and to purge the delivery line, respectively. Also, by placing the discharge control valve at the extinguishing agent container, rather than at the end of the delivery line, a packed condition in the delivery line can be prevented.

DESCRIPTION OF THE PREFERRED EMBODIMENTS

Figure 1:
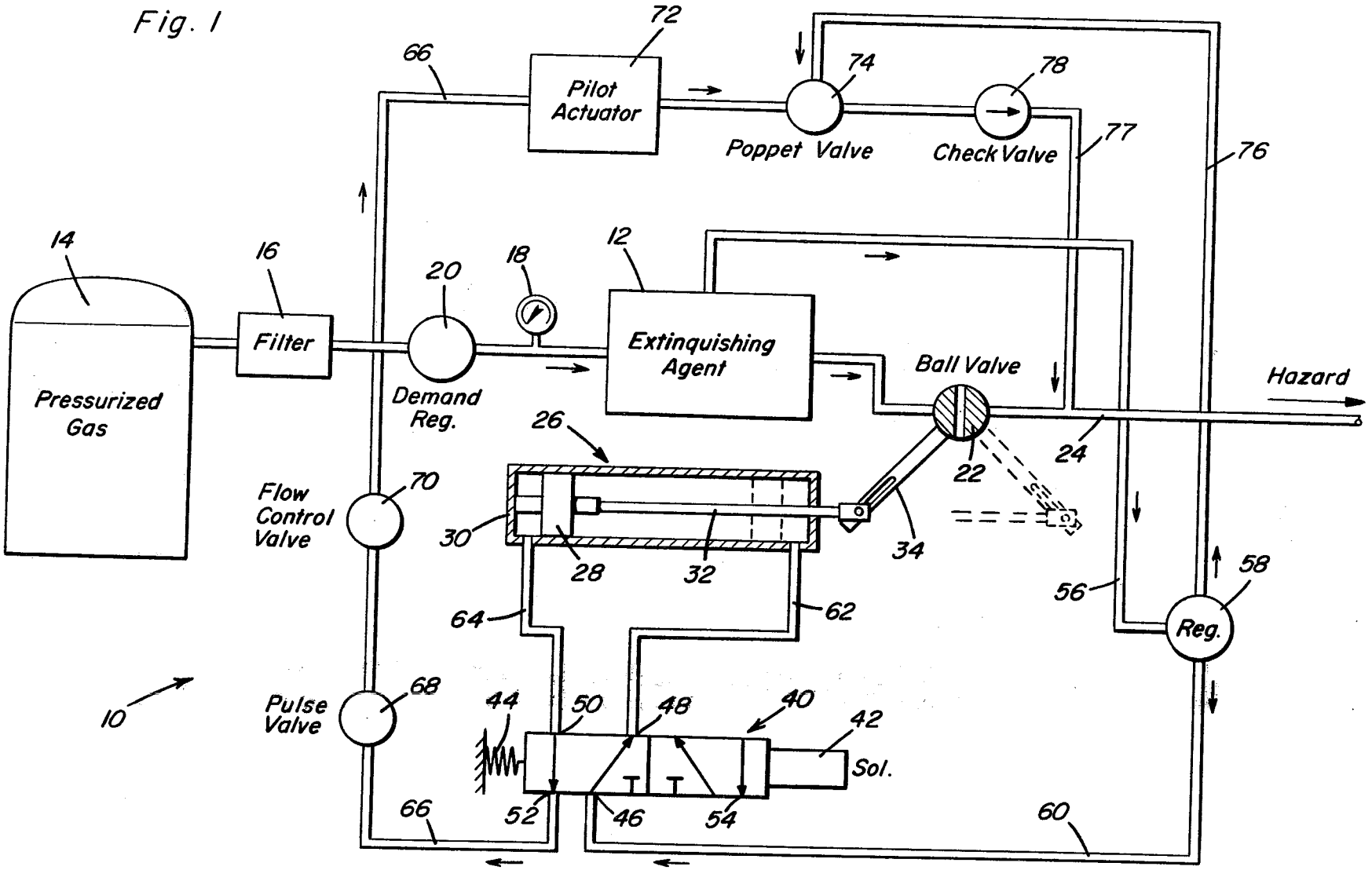
FIG. 1 is a schematic diagram of a portion of one embodiment of the fire extinguishing system of the present invention having means for automatically purging the delivery line.

Referring to FIG. 1, fire extinguishing system 10 includes pressure vessel 12 which contains any conventional extinguishing agent such as a dry chemical extinguished. In the fire extinguishing system illustrated the extinguishing agent pressure vessel is pre-pressurized. It will be understood, however, that the invention broadly includes a system in which the propellant is generated when need or stored in a separate container and introduced into the pressure vessel on demand.

Pressurized gas is introduced into pressure vessel 12 from pressurized gas vessel 14 through filter and moisture trap 16. The pressurized gas may be any propellant gas conventionally employed such as nitrogen or carbon dioxide. The desired pressure in pressure vessel 12, typically 75 to 240 psi, is read on pressure gauge 18 and is maintained by demand regulator 20. The pressurized gas supply can be disconnected from pressure vessel 12 after the pressure vessel is pre-pressurized if replenishing of the propellant gas is not required.

The discharge of extinguishing agent from pressure vessel 12 is controlled by discharge control valve 22, typically a one quarter-turn ball valve. As previously discussed, discharge control valve 22 is preferably mounted directly on pressure vessel 12 at the inlet of delivery tube 24. If desired, a shut-off valve (not shown) can be provided between discharge control valve 22 and pressure vessel 12. Discharge control valve 22 is opened and closed by pneumatic cylinder 26 which includes piston head 28 mounted in housing 30. Piston rod 32 is connected to articulated linkage 34 which is in turn connected to discharge control valve 22.

Pneumatic cylinder 26 is operated by pressurized gas supplied through directional control valve 40. Directional control valve 40 is a 4-way, 2-position, 5-ported valve such as the series SS2000 4-way valve supplied by Parker Hannifin Corporation, Otsego, Michigan. Directional control valve 40 is actuated by solenoid 42 and spring returned by spring 44. When solenoid 42 is de-energized, spring 44 pressure holds the valve spool in its normal position in which pressure port 46 is open to port 48 and port 50 is open to exhaust port 52. When solenoid 42 is energized, pilot pressure shifts the valve spool so that pressure port 46 is open to port 50 and port 48 is open to exhaust port 54 which is vented to the atmosphere, preferably through an exhaust port muffler (not shown).

Pressurized gas for actuating pneumatic cylinder 26 is obtained as illustrated from the existing head pressure in pressure vessel 12 through line 56. It will be understood, however, that the invention contemplates obtaining this pressurized gas from a separate pressurized gas container and, if necessary, for using a separate pressurized gas container as a backup system of pressurized gas. The pressure of the gas in pressure vessel 12, typically 75 to 240 psi as previously mentioned, is reduced by gas pressure regulator 58 to a suitable pressure for operating pneumatic cylinder 26, typically 30 to 40 psi. The supply of pressurized gas, suitably reduced in pressure, is connected to directional control valve 40 through line 60. With solenoid 42 de-energized, pressurized gas is supplied to pneumatic cylinder 26 via lines 62 and acts on the right hand face of piston head 28. When solenoid 42 is energized, pressurized gas is supplied to pneumatic cylinder 26 via line 64 and acts on the left hand face of piston head 28.

With continued reference to FIG. 1, the means for automatically purging delivery hose 24 will be described. Pulse valve 68 is mounted in purge control line 66 which is connected to port 52 of directional control valve 40. Pulse valve 68 acts to convert a continuous supply of inlet gas into a pulse of short duration (e.g., about 50 milliseconds). Pulse valve 68 can be a normally open 3-way valve that closes shortly after being pressurized and remains closed until the supply pressure is exhausted such as through a vent to the atmosphere. A suitable pulse valve is valve PV-1P supplied by Clippard Instrument Laboratory, Inc., Cincinnati, Ohio The pulse of gas is transmitted by purge control line 66 to flow control valve 70 which is used to control or throttle the flow of gas if desired or required. A suitable flow control valve is the series F valve supplied by Clippard Instrument Laboratory, Inc. which gives precise controlled flow and shutoff in one direction and free flow in the reverse direction.

The pulse of gas is transmitted from flow control valve 70 to pilot actuator 72 by purge control line 66. Pilot actuator 72 is suitably a single setting, spring return air pilot actuator such as the MPA-7 actuator supplied by Clippard Instrument Laboratory, Inc. Pilot actuator 72 controls the opening of purge control valve 74 which is suitably a normally closed 3-way poppet valve such as the MJV-3 valve supplied by Clippard Instrument Laboratories, Inc. Pressurized purging gas is supplied at the inlet of purge control valve 74 via line 76 from gas pressure regulator 58. Purge control valve 74 is connected to delivery hose 24 by purge line 77. Check valve 78 is positioned in purge line 77 and prevents extinguishing agent from reaching purge control valve 74.

Figure 2:
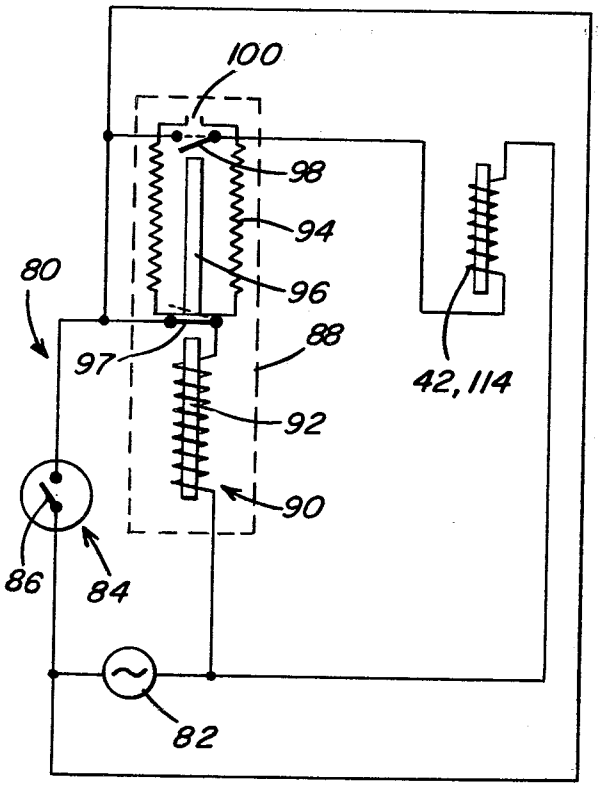
FIG. 2 is a schematic diagram of the hazard detection and pneumatic timing relay portion of the fire extinguishing system of the present invention.

Referring now to FIG. 2, the sensing and timing circuit 80 of fire extinguishing system 10 includes solenoid 42 of directional control valve 40, a source of alternating current 82, temperature sensor 84 having normally open switch 86 and pneumatic timing relay 88. Pneumatic timing relay 88 is suitably a relay such as supplied by RCH Electric Co., Inc., Memphis, Tennessee and described in Bulletin 849A. Pneumatic timing relay 88 includes solenoid 90 having plunger 92, bellows 94 having plunger 96, normally closed switch 97, normally open switch 98 and timing control orifice 100.

Turning now to the operation of fire extinguishing system 10, switch 86 in temperature sensor 84 is closed when a pre-determined temperature is sensed thereby energizing solenoid 90 in pneumatic timing delay 88. Plunger 92 of solenoid 90 strikes plunger 96 and compresses bellows 94. This causes normally closed switch 97 to be opened and normally open switch 98 to be closed as shown in dotted lines thereby energizing solenoid 42 for a pre-determined period of time. The time factor is controlled by the size of orifice 100 which can be manually varied to control the time required to restore bellows 94 to its initial position thereby closing switch 97 and opening switch 98 which de-energizes solenoid 42.

Referring now to FIG. 1, energization of solenoid 42 causes pressure port 46 to be placed in communication with port 50. Pressurized gas enters pneumatic cylinder 26 and causes piston head 28, piston rod 32 and linkage 34 to move to the position shown in dotted lines. This causes discharge control valve 22 to open and extinguishing agent to be discharged through delivery hose 24. At the same time, gas in pneumatic cylinder 26 on the right hand side of piston head 28 is forced out of pneumatic cylinder 26 via line 62, through directional control valve 40 via ports 48 and 54 and is vented to the atmosphere. When solenoid 42 is de-energized by the opening of contact 98 in pneumatic timing relay 88, spring 44 shifts the spool in directional control valve 40 placing pressure port 46 in communication with port 48. Accordingly, pressurized gas enters pneumatic cylinder 26 through line 62 and forces piston head 28, piston rod 32 and linkages 34 back to the position shown in solid lines. This causes discharge control valve 22 to close thereby stopping the discharge of extinguishing agent.

As discharge control valve 22 is being closed, gas is exhausted from pneumatic cylinder 26 via line 64, passes through directional control valve 40 via ports 50 and 52 and appears at the inlet of pulse valve 68. This causes pulse valve 68 to transmit a pulse of gas through flow control valve 70 to pilot actuator 72 which causes normally closed purge control valve 74 to open. Accordingly, after discharge control valve 22 has been closed, a pulse of pressurized gas passes through purge control valve 74 and check valve 78 and purges delivery hose 24 of any accumulated extinguishing agent. If the fire is not yet extinguished, solenoid 42 will again be energized and further extinguishing agent will be discharged through discharge contact valve 22 and delivery line 24 to the hazard area. This cycle is then continuously repeated until the fire is extinguished. Thereafter, the system will continue to be ready to discharge further extinguishing agent if a further fire is sensed by temperature sensor 84.

Figure 3:
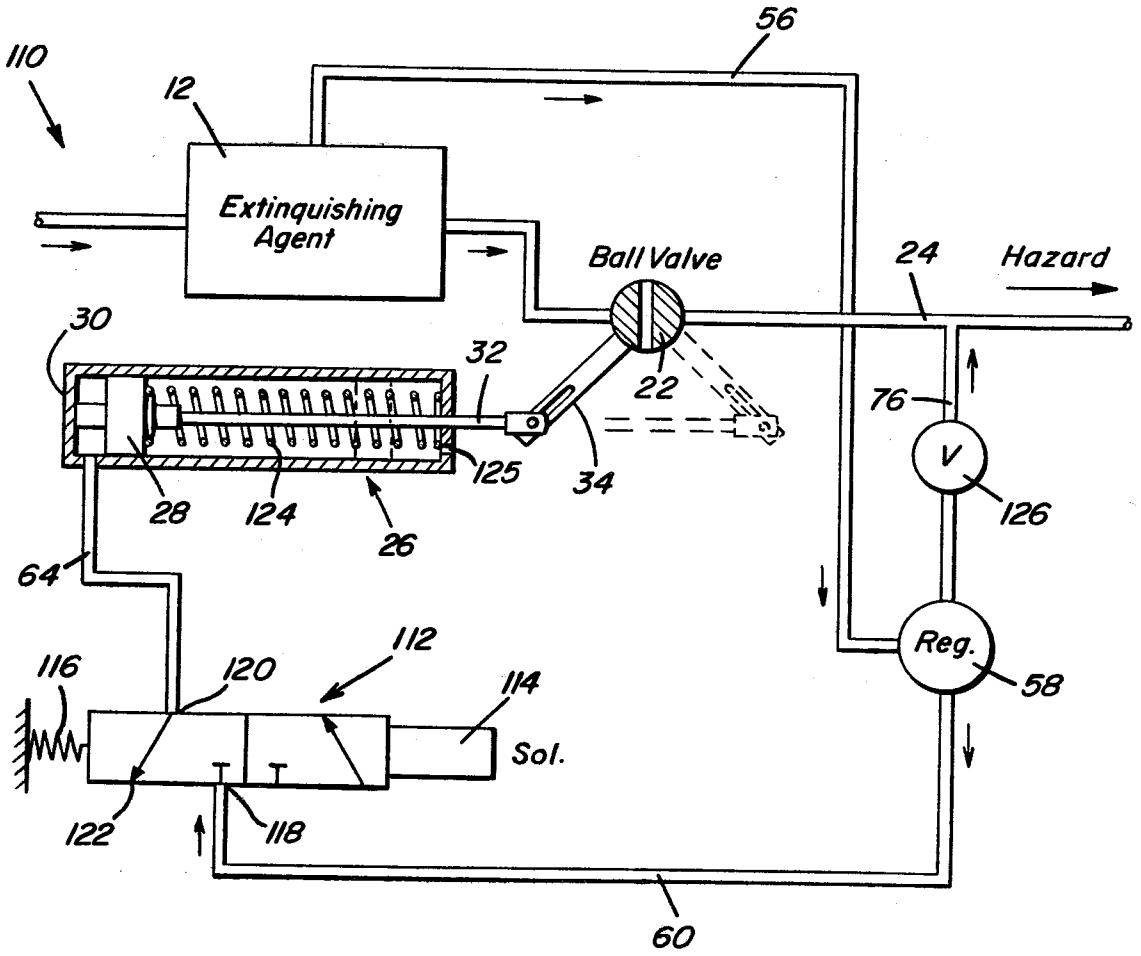
FIG. 3 is a schematic diagram of a portion of another embodiment of the fire extinguishing system of the present invention having means for manually purging the delivery line.

Turning now to FIG. 3, a second embodiment of the fire extinguishing system is shown at 110 in which components which are the same as shown in FIG. 1 are identified by the same reference numerals. In accordance with this embodiment of the invention, delivery line 24 is purged manually rather than automatically. Accordingly, a simplier direction control valve can be employed. More specifically, directional control valve 112 is a 3-way, 2-position, 3-ported valve such as Series T valve supplied by Parker Hannifin. Directional control valve 112 is actuated by solenoid 114 and spring returned by spring 116. When solenoid 114 is de-energized, spring 116 pressure holds the valve spool in its normal position. In this position, pressure port 118 is blocked and port 120 is open to exhaust port 122. When solenoid 114 is energized, the valve spool is shifted so that pressure port 118 is open to port 120 and port 112 is blocked. Pneumatic actuator 26 is the same as in FIG. 1 except for return spring 114 which acts against the right hand face of piston head 28 and air vent 125 in the return spring chamber. In this arrangement, delivery line 24 is vented manually by opening shut-off valve 126 in line 76.

Solenoid 114 of directional control valve 112 is energized and de-energized in the same manner as solenoid 42 described in conjunction with the first embodiment. When solenoid 114 is energized, pressurized gas passes through directional control valve 112 via ports 118 and 120 and enters pneumatic cylinder 26 via line 64. This pressurized gas acts against the left hand face of piston head 28 and moves piston head 28, piston rod 32 and linkage 34 against the force of return spring 124 to the position shown in dotted lines in FIG. 3. This causes discharge control valve 22 to open and extinguishing agent to be delivered through delivery hose 24 to the hazard area. As soon as solenoid 114 is de-energized, return spring 124 forces piston head 28, piston rod 32 and linkage 34 back to the position shown in solid lines. This causes gas to be exhausted from pneumatic cylinder 26 via line 64, to pass through directional control valve 112 via ports 120 and 122 and to be exhausted to the atmosphere, preferably through a muffler (not shown). This cycle is then repeated as described above until the fire is extinguished and then the system resets for extinguishing further fires as described above.

While two embodiments of the present invention have been described above, it will be appreciated that there are many modifications and changes which can be made within the scope of the present invention. For example, pneumatic timing relay 88 can be replaced by a corresponding electrical timer. Also, while only one discharge control valve 22 has been illustrated, it will be appreciated that a plurality of discharge control valves and their associated actuators and timers can be employed. Accordingly, the present invention should not be limited by the specific embodiments illustrated, but only as defined in the appended claims.

I claim;

1. A fire extinguishing system comprising means for containing an extinguishing agent, valve means for controlling the discharge of said extinguishing agent from said containing means and means for automatically and repeatedly opening said discharge control valve means for a pre-determined period of time and then closing said discharge control valve means until the fire is extinguished, said means for opening and closing said discharge control valve means including linkage means adapted to be operated pneumatically and directional control valve means for supplying pressurized gas to pneumatically operate said linkage means.

2. The fire extinguishing system of claim 1 in which said directional control valve means is actuated by solenoid means and further comprising timer means for energizing said solenoid means for a pre-determined period of time.

3. The fire extinguishing system of claim 2 in which said timer means includes second solenoid means and temperature sensor means for energizing said second solenoid means.

4. A fire extinguishing system comprising means for containing an extinguishing agent, valve means for controlling the discharge of said extinguishing agent from said containing means, means for automatically and repeatedly opening said discharge control valve means for a pre-determined period of time and then closing said discharge control valve means until the fire is extinguished, delivery means for delivering said extinguishing agent from said discharge control valve means to the fire, and means for purging said delivery means of accumulated extinguishing agent.

5. The fire extinguishing system of claim 4 in which said discharge control valve means is mounted on said fire extinguishing agent containing means at the inlet end of said delivery means and said purge means is connected to said delivery means downstream of said discharge control valve means.

6. The fire extinguishing agent of claim 4 in which said purging means is manually operated.

7. The fire extinguishing agent of claim 4 in which said purging means automatically purges said deliver means when said discharge control valve means is closed.

8. The fire extinguishing system of claim 1 in which said automatic purging means includes pulse valve means for transmitting a gas pulse of short duration, pilot actuator means activated by said short duration pulse and purge control valve means operated by said pilot actuator means.

9. A fire extinguishing system comprising means for containing an extinguishing agent and for storing a propellant so that said extinguishing agent is pre-pressurized, valve means for controlling the discharge of said extinguishing agent from said containing means, said extinguishing agent being discharged solely by the opening of said discharge control valve means, and means for automatically and repeatedly opening said discharge control valve means for a pre-determined period of time and then closing said discharge control valve means until the fire is extinguished, said means for opening and closing said discharge control valve means including temperature sensor means for sensing a pre-determined temperature and timing relay means coupled to said temperature sensor means for controlling said pre-determined period of time.

10. A fire extinguishing system comprising means for containing an extinguishing agent, valve means for controlling the discharge of said extinguishing agent from said containing means, pneumatic means for opening and closing said discharge control valve means, solenoid-actuated directional control valve means for controlling the flow of pressurized gas to operate said pneumatic means, and timer means for automatically and repeatedly energizing and de-energizing said directional control valve means solenoid to thereby open said discharge control valve means for a pre-determined period of time and close said discharge control valve means until the fire is extinguished.

11. The fire extinguishing system of claim 10 in which said timer means comprises second solenoid means and further comprising temperature sensor means for energizing said second solenoid means.

12. The fire extinguishing system of claim 10 in which said directional control valve means directs pressurized gas to said pneumatic means to open said discharge control valve means when said directional control valve means solenoid is energized and exhausts pressurized gas from said pneumatic means when said directional control valve means solenoid is de-energized.

13. The fire extinguishing system of claim 12 in which said pneumatic means includes spring return means for causing said pneumatic means to close said discharge control valve means when said directional control valve means solenoid is de-energized.

14. The fire extinguishing system of claim 12 in which said directional control valve means directs pressurized gas to said pneumatic means to close said discharge control valve means when said directional control valve means solenoid is de-energized.

* * * * *